US006453999B1

(12) United States Patent
Reinholdt

(10) Patent No.: US 6,453,999 B1
(45) Date of Patent: Sep. 24, 2002

(54) CENTRALIZER

(75) Inventor: Bernd Reinholdt, Hanover (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/601,297

(22) PCT Filed: Feb. 8, 1999

(86) PCT No.: PCT/GB99/00398

§ 371 (c)(1),
(2), (4) Date: Oct. 16, 2000

(87) PCT Pub. No.: WO99/42698

PCT Pub. Date: Aug. 26, 1999

(30) Foreign Application Priority Data

Feb. 23, 1998 (GB) ..... 9803668

(51) Int. Cl.[7] ..... E21B 17/10
(52) U.S. Cl. ..... 166/241.3; 166/241.6
(58) Field of Search ..... 166/241.3, 241.6, 166/172–174; 138/108, 112, 155, 134, 119, 120

(56) References Cited

U.S. PATENT DOCUMENTS

| | | | | |
|---|---|---|---|---|
| 1,651,088 A | | 11/1927 | Fentress | |
| 1,699,087 A | | 1/1929 | Woodmansee et al. | |
| 1,801,294 A | | 4/1931 | Sutton | |
| 1,831,999 A | | 11/1931 | Bull | |
| 1,893,020 A | * | 1/1933 | Cushing | 175/325.7 |
| 1,913,365 A | | 6/1933 | Bailey | |
| 1,923,328 A | | 8/1933 | Reed | 255/28 |
| 2,601,478 A | | 6/1952 | Weir | 308/6 |
| 2,812,200 A | | 11/1957 | Yeargan | 287/52.09 |
| 2,860,013 A | | 11/1958 | Medearis | 308/4 |
| 2,897,016 A | | 7/1959 | Baker | 308/4 |
| 3,052,310 A | | 9/1962 | Kinzbach | 175/406 |
| 3,054,646 A | | 9/1962 | Minor | 308/4 |
| 3,164,216 A | | 1/1965 | Hall et al. | 175/323 |
| 3,669,190 A | | 6/1972 | Sizer et al. | 166/315 |

(List continued on next page.)

FOREIGN PATENT DOCUMENTS

| | | | |
|---|---|---|---|
| CA | 1 044 220 | 12/1978 | E21B/17/10 |
| EP | 0 333 450 | 9/1989 | E21B/17/10 |
| GB | 2 233 690 | 1/1991 | E21B/17/10 |
| GB | 2 257 447 | 1/1993 | E21B/17/10 |
| RU | 976 020 | 11/1982 | E21B/29/10 |
| SU | 2 012 769 | 5/1994 | E21B/17/10 |
| WO | WO 85/05414 | 12/1985 | F16B/19/10 |
| WO | WO 91/08374 | 6/1991 | E21B/17/10 |
| WO | WO 93/24728 | 12/1993 | E21B/17/10 |
| WO | WO 95/05521 | 2/1995 | E21B/17/10 |
| WO | WO 95/10685 | 4/1995 | E21B/17/10 |
| WO | WO 95/11368 | 4/1995 | E21B/17/10 |
| WO | WO 95/21986 | 8/1995 | E21B/17/10 |
| WO | WO 96/09459 | 3/1996 | E21B/17/10 |
| WO | WO 96/34173 | 10/1996 | E21B/17/10 |
| WO | WO 97/08425 | 3/1997 | E21B/23/00 |
| WO | WO 98/07953 | 2/1998 | E21B/17/10 |
| WO | WO 98/40601 | 9/1998 | E21B/17/10 |
| WO | WO 99/04132 | 1/1999 | E21B/17/10 |

OTHER PUBLICATIONS

Derwent Abstract, Accession No.: 96–127722/13, Dated Jul. 9, 1995.

Derwent Abstract, Accession No.: 84–311506/50, Dated Apr. 30, 1984.

*Primary Examiner*—David Bagnell
*Assistant Examiner*—Zakiya Walker
(74) *Attorney, Agent, or Firm*—Moser, Patterson & Sheridan, L.L.P.

(57) ABSTRACT

A centralizer which comprises a pair of annular bands (2, 3) which are spaced apart by a plurality of hollow members (4 to 9) characterized in that the hollow members (4 to 9) are each provided with at least one window (24, 25, 26) having a roller (12, 13, 14) freely rotatably mounted therein.

8 Claims, 2 Drawing Sheets

U.S. PATENT DOCUMENTS

Figure 1:
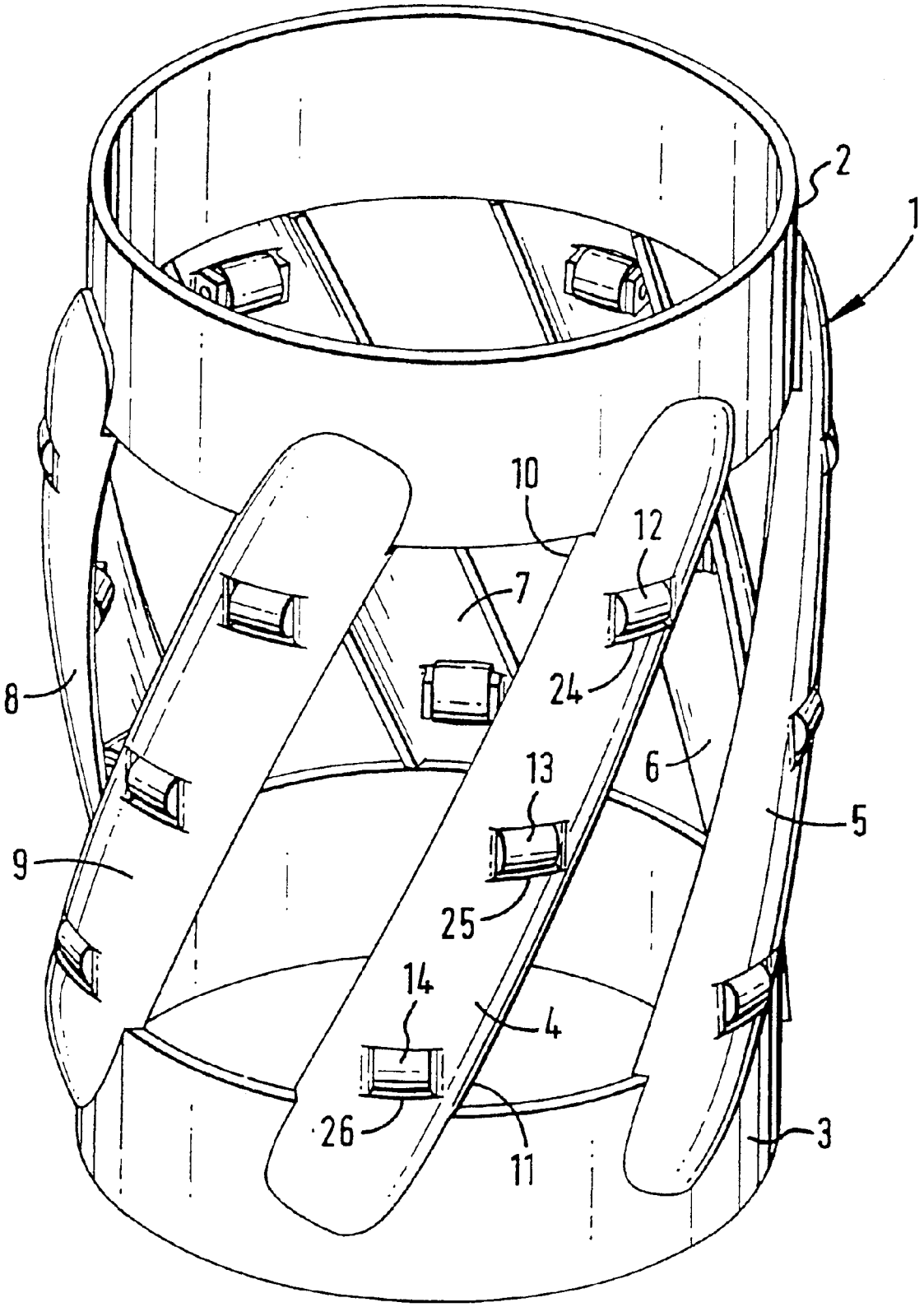

| | | | | | |
|---|---|---|---|---|---|
| 3,797,592 | A | | 3/1974 | Goodfellow | 175/325 |
| 3,894,780 | A | | 7/1975 | Broussard | 308/4 A |
| 4,013,325 | A | | 3/1977 | Rear | 308/4 A |
| 4,266,578 | A | | 5/1981 | Swain et al. | 138/110 |
| 4,273,372 | A | | 6/1981 | Sheshtawy | 294/86.15 |
| 4,336,637 | A | | 6/1982 | Patterson | 24/349 DP |
| 4,548,284 | A | | 10/1985 | Shinn et al. | 175/346 |
| 4,557,327 | A | * | 12/1985 | Kinley et al. | 166/241.5 |
| 4,583,604 | A | | 4/1986 | Greer | 175/346 |
| 4,628,874 | A | | 12/1986 | Barlow | 123/90.5 |
| 4,796,670 | A | | 1/1989 | Russell, et al. | 138/110 |
| 4,913,229 | A | | 4/1990 | Hearn | 166/156 |
| 4,919,205 | A | | 4/1990 | Dollison | 166/241 |
| 4,958,692 | A | | 9/1990 | Anderson | 175/323 |
| 5,099,807 | A | | 3/1992 | Devine | 123/90.48 |
| 5,170,847 | A | | 12/1992 | Mims et al. | 166/383 |
| 5,180,010 | A | | 1/1993 | Stout et al. | 166/212 |
| 5,186,264 | A | | 2/1993 | Du Chaffaut | 175/27 |
| 5,358,040 | A | * | 10/1994 | Kinley et al. | 166/241.3 |
| 5,409,280 | A | | 4/1995 | Hill | 294/16 |
| 5,580,114 | A | | 12/1996 | Palmer | 394/86.15 |
| 5,676,638 | A | | 10/1997 | Shefi | 601/124 |
| 5,692,562 | A | | 12/1997 | Squires | 166/68.5 |
| 5,692,563 | A | * | 12/1997 | Krueger et al. | 166/85.5 |
| 5,778,976 | A | * | 7/1998 | Murray | 166/241.6 |
| 5,901,798 | A | | 5/1999 | Herrera et al. | 175/325.3 |
| 6,050,341 | A | | 4/2000 | Metcalf | 166/383 |
| 6,209,667 | B1 | | 4/2001 | Murray et al. | 175/325.3 |
| 6,250,406 | B1 | | 6/2001 | Luke | 175/325.2 |

* cited by examiner

CENTRALIZER

BACKGROUND OF THE INVENTION

1. Field of the Invention

This invention relates to centralizers for use in the construction of oil and gas wells.

2. Description of the Related Art

During the construction of oil and gas wells a borehole is drilled into the ground. A string of casing is then lowered down the borehole. The annular space between the casing and the borehole is then filled with cement to set the string of casing in place.

An extension of the borehole may be drilled and a second string of casing or a liner is then lowered through the first casing string and into the extension of the borehole. It is then set in place.

It is important to ensure that the casing or liner is held centrally in the borehole during cementation and it is usual to provide the casing with a plurality of centralizers which act between the casing and the borehole.

It is also known to use centralizers to centre one tubular within another.

One known type of centralizer is described in co-pending PCT Application Number PCT/GB97/02249 which centralizer comprises a pair of annular bands for encircling a tubular to be centralised. The annular bands are spaced apart by a plurality of ribs inclined to the longitudinal axis of the centraliser.

One problem with such centralizers is that as the casing or liner is lowered into a previously set casing, or into open hole, the friction created between the centralizer and casing/open hole limits the distance which the casing or liner can be pushed from the surface. This problem is particularly acute in wells which have long, near horizontal sections.

PCT Publication Number WO 95/21986 discloses a drill casing installation device with external cylindrical rollers. However, the cylindrical rollers tend to jam in certain conditions.

BRIEF SUMMARY OF THE INVENTION

PCT Publication Number WO 96/34173 discloses a drill string fitting which is both rotational radially and comprises rollers for axial movement. However, the fitting tends to disintegrate if it becomes necessary to push or pull them through a restriction.

According to the present invention there is provided a centralizer which comprises a pair of annular bands which are spaced apart by the plurality of hollow members characterised in that said hollow members are each provided with at least one window having a roller freely rotatably mounted therein.

Other features of the invention are set out in the Claims.

BRIEF DESCRIPTION OF THE SEVERAL VIEWS OF THE DRAWING(S)

Figure 2:
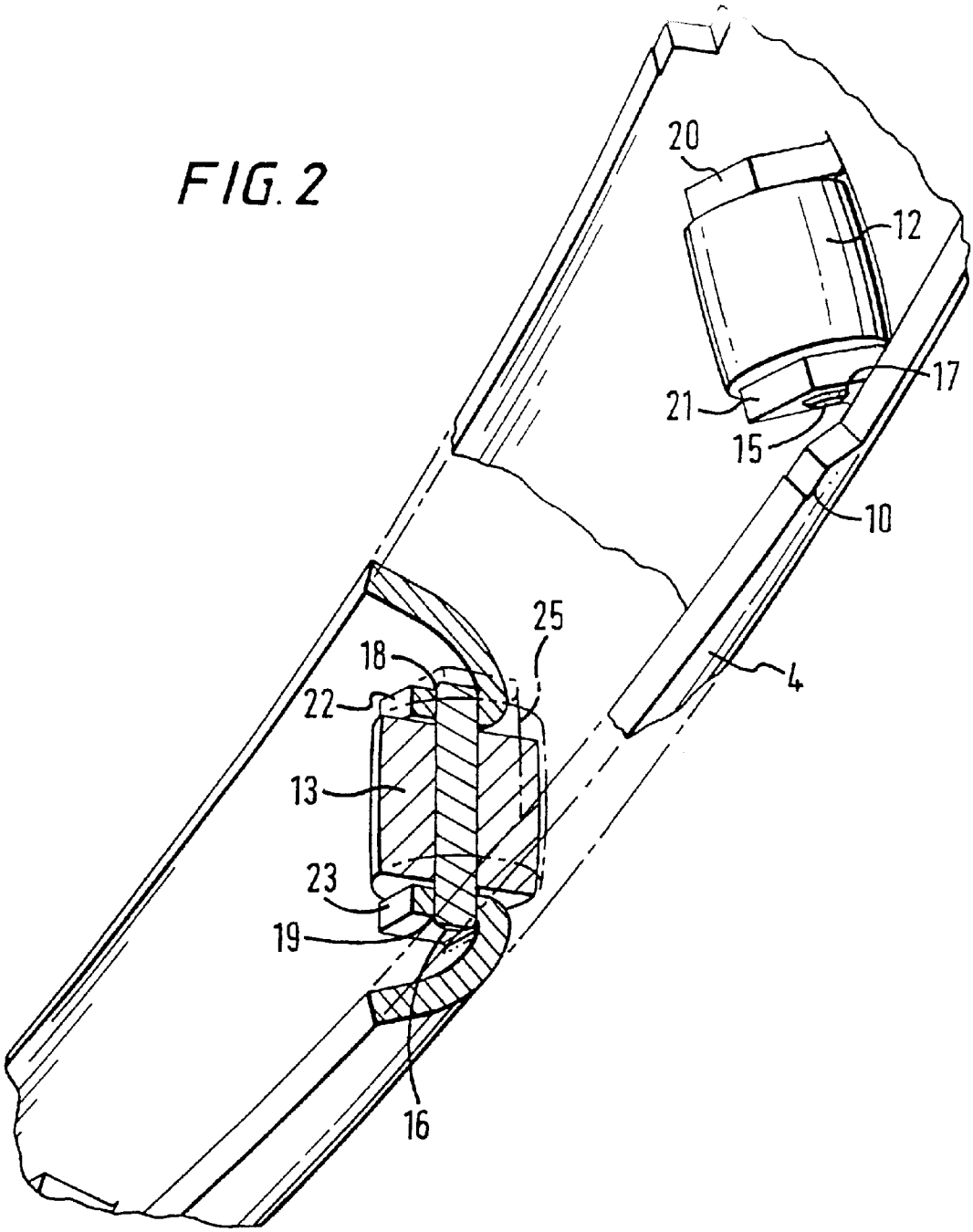

For a better understanding of the invention, reference will now be made, by way of example, to the accompanying drawings, in which:

FIG. 1 is an isometric view of a centralizer in accordance with the invention; and FIG. 2 is an isometric view, partly in cross section, of the inside of a part of the centralizer of FIG. 1.

DETAILED DESCRIPTION OF THE INVENTION

Referring to FIG. 1 there is shown a centralizer 10 which is generally identified by reference numeral 1.

The centralizer 1 comprises two annular bands 2 and 3 which are spaced apart by six members 4 to 9. Each member 4 to 9 is inclined at an angle of from between 20° to 60° and preferably from about 30° to 45° to the longitudinal axis of the centralizer 1.

The members 4 to 9 are substantially the same, accordingly reference will hereinafter be made to member 4 only.

Member 4 is hollow, being generally U-shape in cross-section, and has skirt portions 10, 11 which extend radially inwardly and finish flush with the radially inner surface of the two annular bands 2 and 3. The member 4 is formed from a thin sheet of steel which is about 3 mm in thickness. The member 4 is hollow. The member 4 is also tapered both radially and circumferentially at each end to facilitate movement of the centralizer 1 in the borehole.

Member 4 is provided with cylindrical rollers 12, 13, 14. Each cylindrical roller 12, 13, 14 is free to rotate about an axis which is generally perpendicular to the longitudinal axis of the centralizer 1 (see FIG. 2). The cylindrical rollers 12, 13, 14 project from the member 4 by approximately 3 mm to 5 mm.

The ends of each axle 15, 16 are located in holes 17, 18, 19 in flanges 20, 21, 22, 23. The flanges 20, 21, 22, 23 are formed by pressing windows 24, 25, 26 in the member into the hollow. The cylindrical rollers are made of steel but could be made from a zinc alloy, PTFE, an elastomer, bronze, brass or other bearing material. The cylindrical rollers 12, 13 14 are approximately 15–20 mm in diameter and approximately 15 to 20 mm in length.

The clearance between the outer periphery of each roller and its associated window is sufficient to inhibit typical particles wedging between the two and inhibiting rotation of the roller. Early tests suggest that the clearance should be at least 1 mm, preferably at least 2 mm, more preferably at least 3 mm and advantageously at least 4 mm.

In use, the centralizer 1 is slid over a tubular (not shown). The centralizer 1 may be secured by stop collars (not shown) placed above and below the centralizer or allowed to slide along the tubular between boxes. A plurality of centralizers 1 are arranged on a string of tubulars, which may form a liner, which is then lowered through previously set casing and into an open, typically near horizontal, bore hole. The cylindrical rollers 12, 13, 14 roll along the inner surface of the liner and set casing and subsequently along the surface of the borehole.

Once the liner has reached its destination, which may be up to 20 km from the well head, the liner may be hung and set in a conventional manner.

Occasionally, part of the borehole will collapse when running liners. The usual procedure when this occurs is to withdraw the liner, make good the problem as necessary and reinstate the liner. Although the liner can usually be withdrawn without too much difficulty the forces imposed on traditional centralizers often result in their disintegration with the result that broken parts of centralizers remain in the borehole. This is most undesirable. Applicants PCT Publication Number WO 96/09459 addresses this problem by providing a centralizer with members which have sufficient strength to centralize the liner but which will collapse if with-drawn through a relatively rigid constriction. The underlying principle is that it is better to replace a permanently deformed centralizer at the surface rather than to leave parts of a disintegrated centralizer in the borehole. Typically, the members should substantially completely collapse when subjected to a lateral load of from 5 to 15 tonnes with 11 tonnes being currently used for design purposes for most occasions.

The cylindrical rollers 12, 13, 14 are of small diameter, so that significant collapse of the members 4 to 9 is possible. The cylindrical rollers 12, 13 14 may also be designed to collapse under a similar lateral load, ie of the order of from 5 to 15 tonnes.

What is claimed is:

1. A centralizer which comprises a pair of annular bands (2, 3) which are spaced apart by a plurality of hollow members (4 to 9), characterised in that said hollow members (4 to 9) are each provided with at least one window (24, 25, 26) having a roller (12, 13, 14) freely rotatably mounted therein and forming a fluid path between an outside and an inside of the centralizer.

2. A centralizer as claimed in claim 1, wherein said hollow members (4 to 9) are inclined to the longitudinal axis of said centralizer.

3. A centralizer as claimed in claim 1, wherein said rollers (12, 13, 14) are cylindrical.

4. A centralizer as claimed in claim 1, wherein said roller (12, 13, 14) is 15 to 20 mm in diameter.

5. A centralizer as claimed in claim 1, wherein each of said hollow members (4 to 9) comprises three windows (24, 25, 26), each window (24, 25, 26) having a roller (12, 13,14) freely rotatably mounted therein.

6. A centralizer as claimed in claim 1 wherein said roller (12, 13, 14) is freely rotatably mounted on an axle (15, 16) mounted on a flange (20, 21, 22, 23).

7. A centralizer as claimed in claim 6, wherein said flange (20, 21, 22, 23) is formed from the formation of said window (24, 25, 26).

8. A centralizer as claimed in claim 1, wherein said roller (12, 13, 14) is spaced between 1 mm and 5 mm from the edge of the window in which it is rotatably mounted.

* * * * *